US008047272B2

(12) United States Patent
Whittenberger et al.

(10) Patent No.: US 8,047,272 B2
(45) Date of Patent: Nov. 1, 2011

(54) HIGH-TEMPERATURE HEAT EXCHANGER

(75) Inventors: William A. Whittenberger, Leavittsburg, OH (US); Gordon W. Brunson, Chagrin Falls, OH (US); John H. Becker, Atwater, OH (US)

(73) Assignee: Catacel Corp., Garrettsville, OH (US)

( * ) Notice: Subject to any disclaimer, the term of this patent is extended or adjusted under 35 U.S.C. 154(b) by 1058 days.

(21) Appl. No.: 11/868,805

(22) Filed: Oct. 8, 2007

(65) Prior Publication Data

US 2008/0072425 A1 Mar. 27, 2008

Related U.S. Application Data

(63) Continuation-in-part of application No. 11/225,771, filed on Sep. 13, 2005, now Pat. No. 7,594,326, and a continuation-in-part of application No. 11/225,763, filed on Sep. 13, 2005, now Pat. No. 7,591,301, and a continuation-in-part of application No. 29/280,526, filed on May 30, 2007, now Pat. No. Des. 560,276.

(51) Int. Cl.

| | |
|---|---|
| ***F28F 3/00*** | (2006.01) |
| ***F28D 9/00*** | (2006.01) |
| ***B01J 8/02*** | (2006.01) |

(52) U.S. Cl. ..... 165/164; 165/165; 165/166; 165/133; 165/DIG. 399; 422/180; 422/222

(58) Field of Classification Search ..... 422/180, 422/222; 165/133, 164, 165, 166, DIG. 399
See application file for complete search history.

(56) References Cited

U.S. PATENT DOCUMENTS

| | | | |
|---|---|---|---|
| 2,216,864 | A | 10/1940 | Wasmund |
| D156,294 | S | 11/1949 | Trow |
| 2,553,030 | A | 5/1951 | Bell |
| D165,089 | S | 11/1951 | McElgin |
| 2,905,201 | A | 9/1959 | McNaughton |
| 2,963,783 | A | 12/1960 | Field |
| 3,059,563 | A | 10/1962 | Larson |
| 3,165,152 | A | 1/1965 | Jones |
| 3,734,177 | A | 5/1973 | Bellovary et al. |
| 3,847,211 | A | 11/1974 | Fischel et al. |
| 3,907,050 | A | 9/1975 | Mullings |
| 4,126,268 | A | 11/1978 | Vitale |
| 4,131,159 | A | 12/1978 | Long |
| D252,641 | S | 8/1979 | LaZar |
| D253,067 | S | 10/1979 | Hartley |

(Continued)

FOREIGN PATENT DOCUMENTS

DE 10302948 A1 * 8/2004

(Continued)

*Primary Examiner* — Jennifer A Leung
(74) *Attorney, Agent, or Firm* — Pearne & Gordon LLP

(57) ABSTRACT

A low-cost, high-temperature heat exchanger is made from a notched piece of metal, the metal being folded back and forth upon itself to form a monolith. The notches in the metal piece create openings, communicating with distinct sides of the monolith. Ducts are attached to the openings. Cut pieces of corrugated metal, which may have a catalyst coating, are inserted between folds of the monolith. The heat exchanger may be used as part of a fuel cell system, or in other industrial applications, to recover waste heat, or to conduct various catalytic and non-catalytic reactions. The invention also includes an element, or building block, for a high-temperature heat exchanger, including a folded metal monolith with metal combs inserted, the monolith and the combs defining seams which are hermetically sealed.

11 Claims, 15 Drawing Sheets

U.S. PATENT DOCUMENTS

| | | | |
|---|---|---|---|
| D256,156 | S | 7/1980 | Garritson |
| D279,029 | S | 5/1985 | Sieverding |
| 4,742,957 | A | 5/1988 | Mentuch |
| D297,044 | S | 8/1988 | Van Ee |
| D297,359 | S | 8/1988 | Schmid et al. |
| D319,499 | S | 8/1991 | Hague |
| 5,282,507 | A | 2/1994 | Tongu et al. |
| 5,311,930 | A | 5/1994 | Bruenn |
| 5,398,752 | A | 3/1995 | Abbott |
| 5,538,293 | A | 7/1996 | Kolt |
| 5,681,538 | A | 10/1997 | Sung et al. |
| 5,709,264 | A | 1/1998 | Sweeney et al. |
| D398,049 | S | 9/1998 | Willis |
| 5,893,408 | A | 4/1999 | Stark |
| 6,059,023 | A | 5/2000 | Kurematsu |
| 6,207,116 | B1 | 3/2001 | Heed |
| 6,244,333 | B1 | 6/2001 | Bergh et al. |
| 6,364,007 | B1 | 4/2002 | Fischer |
| 6,919,055 | B2 | 7/2005 | Kondo |
| 6,920,918 | B2 | 7/2005 | Knecht et al. |
| 6,920,920 | B2 | 7/2005 | Whittenberger |
| 7,150,099 | B2 | 12/2006 | Whittenberger et al. |
| 7,159,649 | B2 | 1/2007 | Thyrum et al. |
| 7,284,599 | B2 | 10/2007 | Karoliussen |
| D560,276 | S | 1/2008 | Whittenberger |
| D560,376 | S | 1/2008 | Whittenberger |
| 2005/0217836 | A1 | 10/2005 | Whittenberger et al. |
| 2006/0048926 | A1 | 3/2006 | Richter |
| 2006/0153755 | A1 | 7/2006 | Obuchi et al. |
| 2007/0056164 | A1 | 3/2007 | Whittenberger |
| 2007/0056717 | A1 | 3/2007 | Whittenberger |
| 2008/0072425 | A1 | 3/2008 | Whittenberger et al. |
| 2008/0164014 | A1 | 7/2008 | Nakamura |

FOREIGN PATENT DOCUMENTS

| | | |
|---|---|---|
| EP | 0 844 454 | 5/1998 |
| GB | 2 033 570 | 5/1980 |
| GB | 2 158 569 | 11/1985 |
| JP | 55118598 A | 9/1980 |
| WO | 83/01998 | 6/1983 |
| WO | 99/24772 | 5/1999 |

* cited by examiner

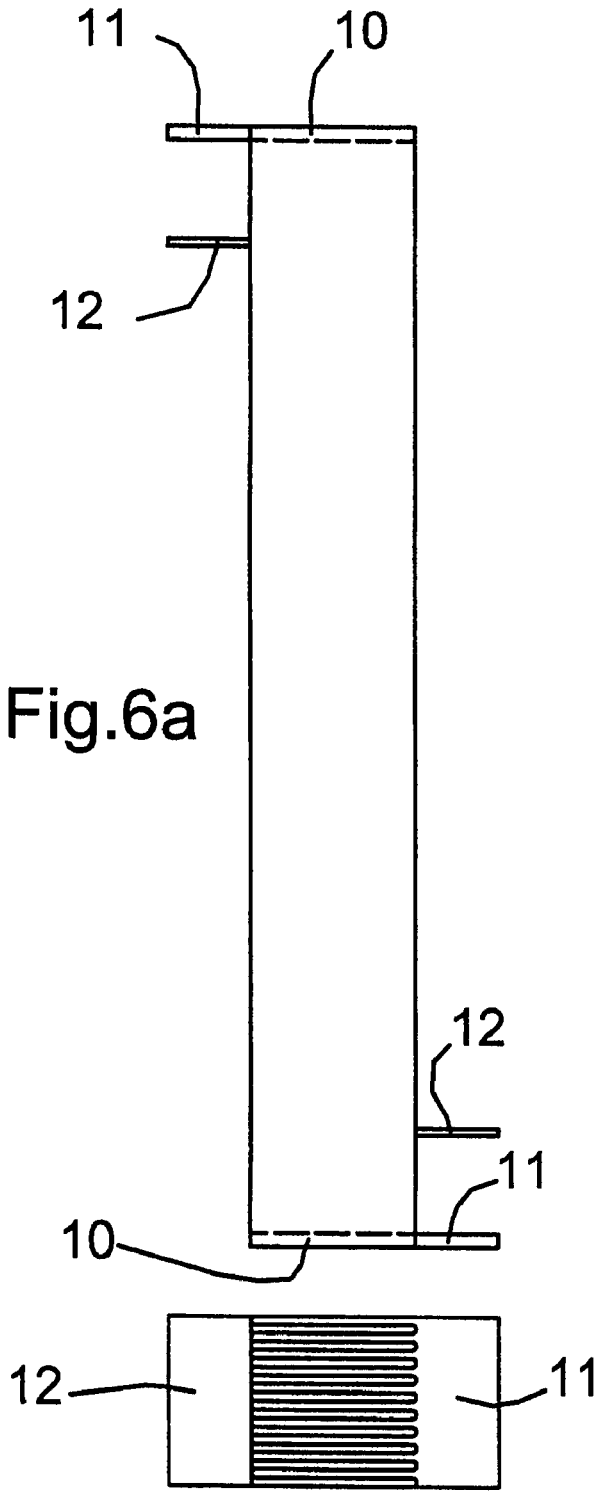
Fig.6a
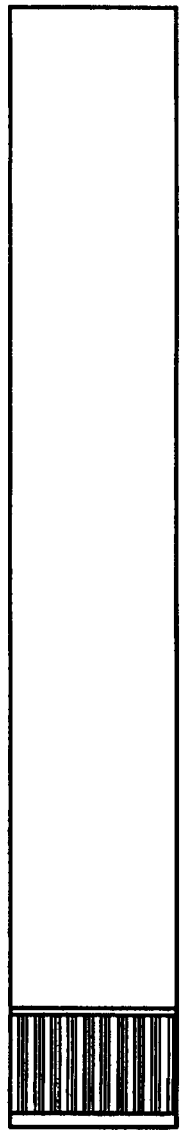
Fig.6b
Fig.6c

HIGH-TEMPERATURE HEAT EXCHANGER

CROSS-REFERENCE TO RELATED APPLICATIONS

This application is a continuation-in-part of U.S. application Ser. No. 11/225,771 filed Sep. 13, 2005, now U.S. Pat. No. 7,594,326; and is also a continuation-in-part of U.S. application Ser. No. 11/225,763 filed Sep. 13, 2005, now U.S. Pat. No. 7,591,301; and is also a continuation-in-part of U.S. application Ser. No. 29/280,526 filed May 30, 2007, now U.S. Pat. No. D 560,276, the entire contents of all of which are hereby incorporated by reference.

BACKGROUND OF THE INVENTION

This invention relates to the field of heat exchange. The invention provides a low-cost structure, capable of tolerating high operating-temperatures, comprising a heat-exchanger or reactor such as is typically used in fuel processing or heat recovery for fuel cell systems.

In a fuel cell system, heat exchangers are typically provided to recover waste heat from a hot exhaust stream, typically 500-1000° C., and to transfer the recovered heat to one of the inputs to the system, such as fuel, air, or steam. In addition, heat exchangers that contain catalytic coatings are used as fuel processing reactors. Each system may have a unique configuration, but virtually all such systems can be made more efficient by the appropriate use of heat exchangers. In general, there is a need for a low-cost heat exchanger that can tolerate the above-described high-temperature environment, and which can be provided in large quantities, so that heat exchangers can be installed at multiple locations within a facility, at a reasonable cost. Such a heat exchanger has even more utility if one or more catalytic coatings can easily be applied to its working surfaces.

One way to limit the cost of a heat exchanger is to use a less expensive material in the manufacturing process. The use of metal foil materials, having a thickness in the range of about 0.001-0.010 inches, reduces expense by using less material overall. However, foil materials are difficult to seal or weld using conventional processes. Furnace brazing may be used to join certain high-temperature foil materials that contain nickel. Alloys that may be easily brazed include the 300 series stainless steel family (i.e. alloys known by the designations 304, 316, 321, etc.), the Inconel family (having designations 600, 601, 625, etc.), and other exotic alloys (Hastelloy-X and Haynes 230, for example). (Inconel is a trademark of Huntington Alloys Corp., of Huntington, W. Va.) These brazable alloys are always expensive because they contain nickel. To limit the cost of material, it is highly desirable to use a high-temperature foil alloy that does not contain nickel.

A desirable choice is the product known as Fecralloy, which contains iron, chromium, and aluminum (Fecralloy is a now-cancelled trademark, formerly registered by the United Kingdom Atomic Energy Authority). Fecralloy is quite inexpensive, relative to other high-temperature alloys, but it is difficult to braze. Because Fecralloy contains aluminum, the application of heat causes aluminum oxide to form, making it difficult to seal the structure by brazing.

The above problem encountered with Fecralloy can be at least partly overcome by choosing a thicker material, and using a conventional welding process. But increasing the thickness of the material increases the cost of the product, and therefore offsets the cost advantage obtained by the choice of Fecralloy.

The heat exchanger of the present invention provides a solution to the above-described problems, by providing a high-temperature heat exchanger that is both effective and inexpensive. The present invention makes it economically feasible to place heat exchangers at multiple points in a fuel cell system. The present invention could also be used in other industrial applications, such as in chemical plants.

The heat exchanger of the present invention may also be used in a steam reforming process, in which hydrocarbons are converted to hydrogen, for use in operating a fuel cell. In this process, the heat of catalytic combustion on one side drives the catalytic reaction of steam and fuel on the other side. A steam reforming process is described in US 2004/0060238 A1, US 2006/0008414 A1, and U.S. Pat. No. 7,179,313, the disclosures of which are incorporated by reference herein. The above-cited applications show various uses of heat exchange, such as in conducting an endothermic steam reforming reaction on one side of a metal strip and an exothermic combustion reaction on the other side, or in conducting a water-gas shift reaction. In general, the operation of a fuel cell presents many situations in which heat from an exothermic reaction, or from a hot exhaust source, can be used to heat some other fluid stream. In the reforming process, a single catalyst can be used for both reactions. By switching the routing of the fluids, each side of the heat exchanger can alternate between the reforming and combustion reactions. During reforming the catalyst is gradually deactivating by coking and other mechanisms, but it is regularly regenerated by the combustion duty. The heat exchanger can also be used to support other endothermic or exothermic reactions, such as water-gas shift, selective oxidation of carbon monoxide. It may also be used to support adsorbing processes such as the removal of sulfur from diesel or jet fuel.

The heat exchanger of the present invention is also compact, making it convenient for use in systems where a large amount of space is not available. The heat exchanger of the present invention also has the advantage of being hermetically sealed, so that there is virtually no possibility of leakage.

SUMMARY OF THE INVENTION

One aspect of the present invention is an element, or building block, for a heat exchanger, comprising a monolith formed of a piece of metal that has been folded back and forth upon itself, and a comb inserted into folds of the monolith, at or near the end of the monolith. The comb and the monolith are in contact along a plurality of seams, and these seams are hermetically sealed, preferably by laser welding. The heat exchanger element can be used to form a complete heat exchanger.

In another aspect, the present invention comprises a complete heat exchanger formed of a monolith made of a piece of metal, preferably a metal foil. The piece of metal foil has notches or cut-outs at opposite ends, and is folded back and forth upon itself to form the monolith, the notches or cut-outs defining openings which provide access to two distinct interior regions of the monolith. A duct-defining means is affixed to both ends of the monolith, at locations corresponding to the openings. The duct-defining means may include a comb having teeth which engage the folds of the monolith, a rectangular piece of metal, a duct collar, a u-shaped metal piece and a duct box which is inserted over the end of the monolith, the duct box including portions which, together with the rectangular piece and a spine of the comb, define a duct. A plurality of distinct cut pieces of corrugated metal, which may optionally be coated, or partially coated, with a catalyst or sorbent, are inserted between folds or channels of the monolith. The duct may be made fluid-impervious by sealing its joints, such as by brazing or by welding, and preferably by laser welding.

The monolith defines two sides, corresponding to the two sides of the original piece of metal that is folded to form the monolith. These sides define distinct fluid flow regions within the monolith. The two ducts, described above, provide fluid access to the two respective regions. Normally the metal defining the monolith is not coated with a catalyst, as such coating makes it difficult to weld or braze the structure. However, it is possible to coat the monolith, if necessary, such as by dip coating after the heat exchanger has been assembled.

The catalyst coating on the corrugated pieces inserted into one region of the monolith may be different from the coating on the pieces inserted into the other region. Thus, two different reactions can be conducted separately, in the two distinct regions within the monolith. The fluids flowing through the two ducts are not in direct fluid contact with each other, but are in heat exchange relationship, these fluids being separated by the folds of the monolith.

In another aspect, the invention comprises a heat exchanger having a metal monolith with a plurality of channels through which fluid flows, wherein said monolith has two ends. A shell comprising two metal cover pieces surrounds the monolith such that the shell is open on both ends to provide fluid flow to the channels. The shell further comprises two fluid openings adjacent the ends of said monolith and at least one comb comprising a spine and a plurality of teeth is attached to one end of the monolith. The teeth of the comb are aligned with a portion of the channels to provide a fluid flow stop at one end of said monolith. A duct collar is attached to one end of said monolith, wherein the comb is positioned between said duct collar and said monolith end. A u-shaped metal piece is also attached to at least one shell fluid opening adjacent an end of the monolith, wherein the u-shaped metal piece and the spine form a duct opening to provide fluid flow to the channels.

The invention also includes a method of making a heat exchanger in accordance with an aspect of the present invention. The method begins with cutting notches into a flat piece of metal, on opposite sides of the piece, and folding the piece of metal back and forth to form a monolith. Next, one attaches combs to the ends of the monolith, by inserting the teeth of the combs into the monolith, so as to engage the folds. Next, one affixes rectangular pieces of metal to the monolith, near the ends. One then inserts duct boxes onto the ends of the monolith. The duct boxes include metal portions which, together with spines of the combs and the rectangular pieces, define complete ducts which provide fluid communication with the respective distinct interior regions of the monolith. A plurality of distinct corrugated pieces of metal are inserted into the spaces between folds of the monolith. The corrugated pieces may be entirely or partly coated with a catalyst. The ducts are preferably sealed by brazing or welding.

In another aspect, the invention includes a method of making a heat exchanger in accordance with an aspect of the present invention. The method comprises folding a piece of metal back and forth upon itself to form a monolith having channels through which fluid flows. Combs are attached to the ends of the monolith, the combs having teeth which engage the channels of the monolith, the combs also having spine portions. Notches are cut into two flat cover pieces of metal, the notches being cut on opposite sides of said flat pieces. The two cover pieces are wrapped around said monolith to form a shell. U-shaped pieces of metal are attached in vicinity of the ends of the monolith such that said u-shaped pieces of metal are in contact or attached to the spines of the combs. Duct collars are inserted onto the ends of the monolith, wherein the duct collars, together with the u-shaped pieces and the spines of the combs, define ducts connected to the monolith for providing fluid flow to the channels.

The present invention therefore has the primary object of providing a low-cost, high-temperature heat exchanger.

The invention has the further object of providing an element, or building block, for a low-cost, high-temperature heat exchanger.

The invention has the further object of providing a low-cost means of transferring heat in a fuel cell system, in an industrial plant or in small portable devices, such as oxygen enrichment systems.

The invention has the further object of providing a high-temperature heat exchanger which may be constructed of relatively inexpensive materials, using simple and economical construction techniques.

The invention has the further object of providing a low-cost, high-temperature heat exchanger which defines two distinct regions, wherein the heat exchanger can be used to conduct separate reactions in such regions.

The invention has the further object of providing a heat exchange structure which is easily coated with one or more catalytic materials to form a heat exchanging reactor.

The invention has the further object of making it economical to provide multiple heat exchangers at multiple locations in an industrial plant.

The invention has the further object of providing a method of making a low-cost, high-temperature heat exchanger.

The invention has the further object of providing a method of making an element, or building block, for a low-cost, high-temperature heat exchanger.

The invention has the further object of reducing the cost of providing heat exchange in a fuel cell system, or in an industrial plant.

The reader skilled in the art will recognize other objects and advantages of the invention, from a reading of the following brief description of the drawings, the detailed description of the invention, and the appended claims.

BRIEF DESCRIPTION OF THE DRAWINGS

FIG. 6*a* provides an elevational view of the folded foil monolith of FIG. 3, and showing components forming ducts at each end.

FIG. 6*b* provides an elevational view of the structure of FIG. 6*a*, the monolith having been rotated by 90.degree. relative to the structure of FIG. 6*a*.

FIG. 6*c* provides an end view of the monolith of FIG. 6*a*.

DETAILED DESCRIPTION OF THE INVENTION

In its most basic form, the present invention comprises a heat exchanger which is constructed of relatively inexpensive, thin metal foil, rated for high temperatures, and in which the joints defined by the heat exchanger are sealed by laser welding. Laser welding makes it possible to use inexpensive, thin foil, while still providing a hermetically sealed structure. The foil used in the present invention preferably has a thickness in the range of about 0.001-0.010 inches, and a more preferred range of about 0.002-0.005 inches.

The invention also includes an element, or building block, for a heat exchanger, comprising a monolith formed of a piece of metal that has been folded back and forth upon itself. A comb is inserted into folds defined by the monolith, at or near an end of the monolith. The comb and the monolith are in contact along a plurality of seams, and these seams are hermetically sealed, preferably by laser welding or by other means. The heat exchanger element can be combined with other structures to form a complete heat exchanger, as will be described below.

Figure 1:
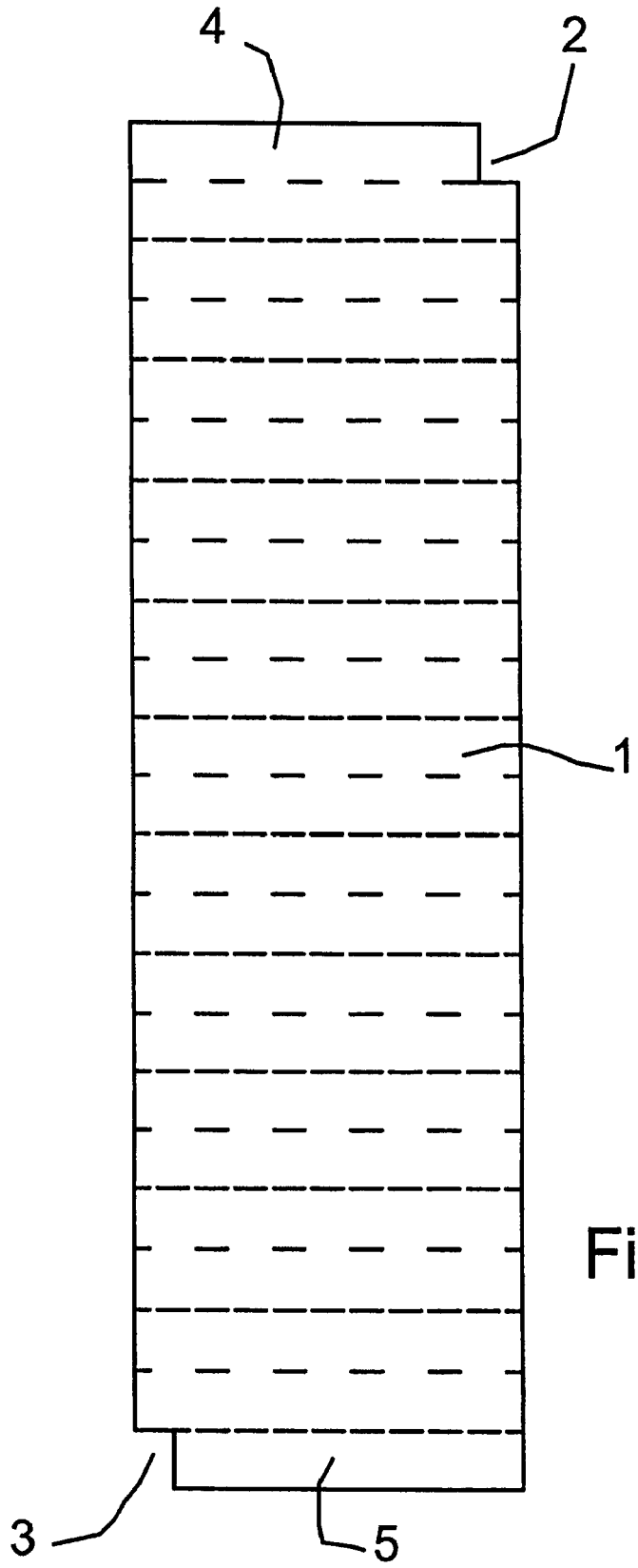
FIG. 1 provides a plan view of a piece of metal foil that has been prepared for fabrication into a heat exchanger of the present invention.

A first embodiment of a completed low-cost heat exchanger of the present invention is manufactured in the following way. First, as shown in FIG. 1, a flat, preferably rectangular, piece of metal foil 1 is prepared. Notches or cut-outs 2 and 3 are formed at opposite corners of the foil. The foil is to be folded back and forth upon itself, in a zigzag fashion, to form a monolith, the dashed lines indicating the locations of the folds. End flaps 4 and 5 will serve as a shell for the monolith, as will be described later.

The thickness of the foil is preferably chosen to be less than about 0.008 inches, so as to minimize the cost. The foil may be nickel-based, which is somewhat more expensive, or more preferably a lower-cost iron-based material such as that sold under the name Fecralloy.

Figure 2:
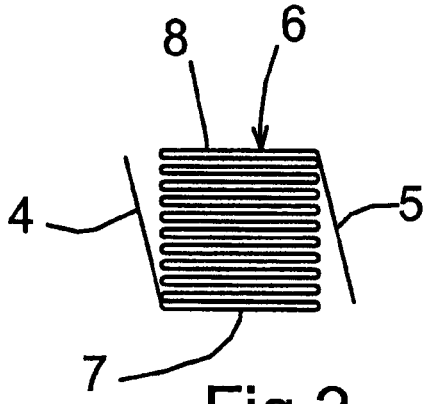
FIG. 2 provides an end view of the foil of FIG. 1, after the foil has been folded back and forth upon itself to define a monolith.
Figure 3:
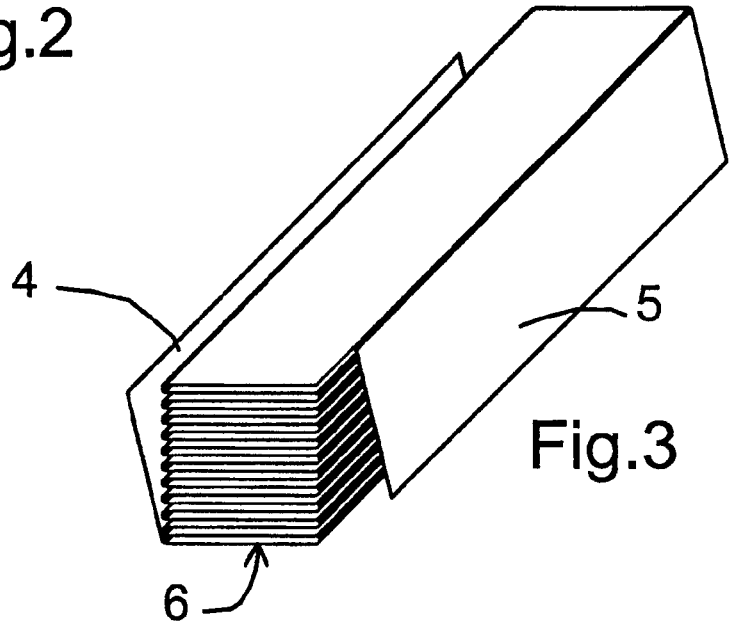
FIG. 3 provides a perspective view of the folded foil of FIG. 2.

FIGS. 2 and 3 illustrate the monolith 6 that is formed by folding the foil of FIG. 1. FIG. 2 shows an end view, and FIG. 3 shows a perspective view. FIGS. 2 and 3 clearly show the end flaps 4 and 5. The end flaps, together with the first and last folds 7 and 8, form a shell that encloses the monolith. The shell, as described so far, is incomplete, insofar as the notches or cut-outs 2 and 3 of FIG. 1 create openings which expose the interior regions of the monolith, as illustrated in FIG. 3.

Figure 4:
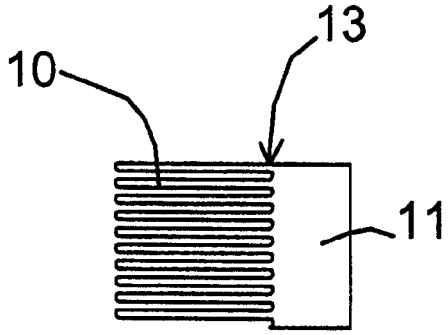
FIG. 4 provides a plan view of a comb which is used in making the heat exchanger of the present invention.

FIG. 4 shows a comb 13 which is to be inserted at the end of the monolith. Each monolith requires two combs, one at each end. The comb serves the purposes of anchoring the folds of the monolith, and of defining part of a duct connected to the monolith. The comb also holds the folds in spaced-apart relationship, facilitating the insertion of cut pieces of corrugated metal foil, as will be described later.

As shown in FIG. 4, the comb includes teeth 10 and spine 11. The spine later becomes a wall of the duct. The comb is preferably made of a material having a greater thickness than that of the foil. For example, and without limitation, the comb could be made of stainless steel, or other high-temperature alloys, having a thickness in the range of about 0.03-0.12 inches, or preferably about 0.09 inches. The comb may be laser-cut from a sheet of metal, or it may be prepared in other ways.

Figure 5:
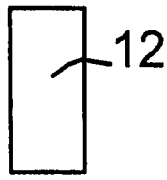
FIG. 5 provides a plan view of a rectangular piece of metal, used in the manufacture of the heat exchanger of the present invention.

FIG. 5 illustrates a rectangular piece of metal 12 which is used to form the wall of the duct which is opposite the wall defined by spine 11 of the comb. Each monolith requires two such rectangular pieces, one for each end.

Depending on the manner of use of the heat exchanger, the rectangular piece can be made of the same material, and having the same thickness, as the comb, or it can be made of thinner material. If the duct is to be welded to an external component, it is preferred that the rectangular piece be as thick as the spine of the comb. If the structure is to be brazed only, the rectangular piece could be of the same thickness as the body of the monolith, which is normally less than that of the spine of the comb.

FIGS. 6*a*-6*c* illustrate the next step in the manufacture of a heat exchanger according to the present invention. FIG. 6*a* shows an elevational view of the monolith, with the combs inserted at both ends, and showing rectangular pieces 12 attached. Each comb is inserted such that its teeth 10 fit between alternate folds of the folded foil. The comb therefore anchors the folds, holding them in the desired spaced-apart position. FIG. 6*a* clearly shows how the rectangular piece 12 and the spine 11 of the comb together define opposing walls of a duct. The rectangular piece 12 is spaced from the end of the monolith by a distance which corresponds to the depth of the notches or cut-outs originally formed in the foil. FIG. 6*b* shows the same structure as FIG. 6*a*, rotated by 90.degree. FIG. 6*c* shows an end view, as seen from the bottom portion of FIG. 6*a*, illustrating the comb and also showing the rectangular piece 12 which is attached to the opposite end of the monolith.

Figure 7A:
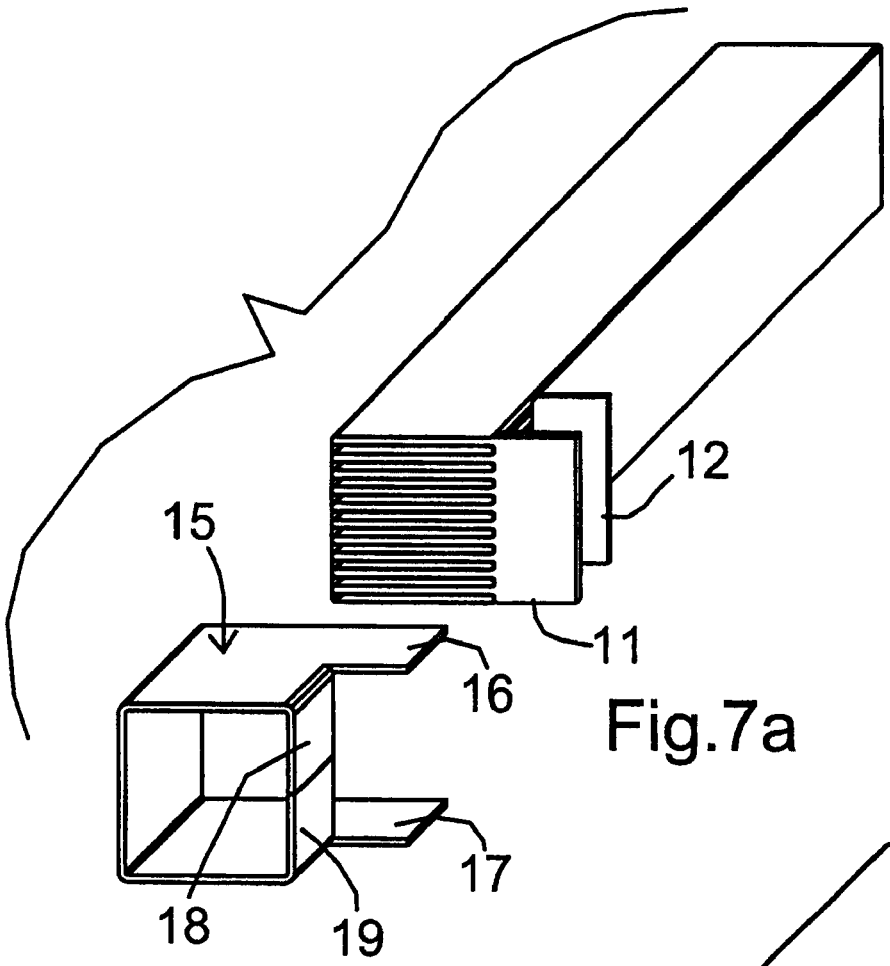
FIG. 7*a* provides an exploded perspective view showing a duct box before it has been installed over an end of the monolith forming the heat exchanger of the present invention.
Figure 7B:
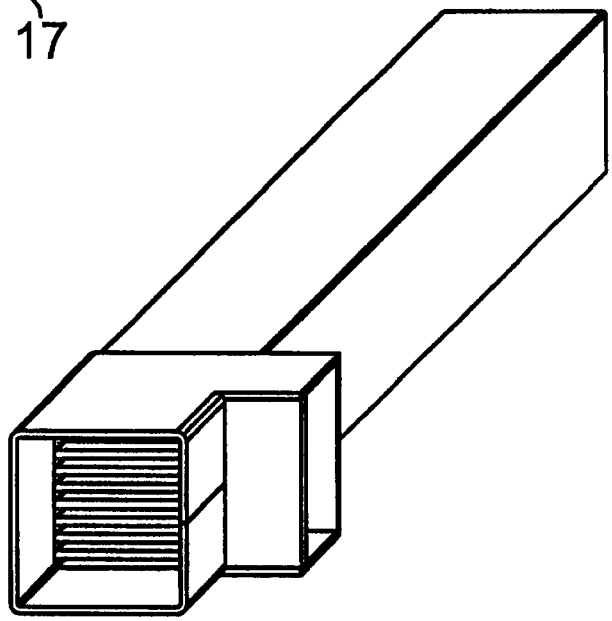
FIG. 7*b* provides a perspective view of the structures shown in FIG. 7*a*, showing the duct box installed over the end of the monolith.

The next step in the manufacture of a heat exchanger of the present invention is illustrated in FIGS. 7*a* and 7*b*. A duct box 15 is inserted over the ends of the monolith, as described below.

As shown in FIG. 7*a*, the duct box comprises a unitary structure having two contiguous parts, the first part defining a complete box with four walls, and the second part being open and having only three walls. In other words, the first part has portions 18 and 19 which are bent over to join each other, thus forming a wall of the box, but the second part has portions 16 and 17 which are not folded over, and which leave the second part of the box without a corresponding wall. The dimensions of the box are chosen such that the second part can snugly fit over the end of the monolith.

As the box is inserted over the end of the monolith, the bent portions 18 and 19 are stopped by the spine 11 of the comb, so that the box can be pushed in no farther. FIG. 7*b* illustrates the structure where the box has been fully inserted over the end of the monolith. Note that in FIG. 7*b*, the portions 16 and 17, together with the spine 11 of the comb and the rectangular piece 12, form a complete duct for providing fluid communication with an interior region of the monolith.

The thickness of the material used to make the duct box can be the same as the thickness of the spine of the comb, or it could be less. If the duct box is to be welded to an external component, it is more convenient to make it thicker, possibly of the same thickness as the spine of the comb. But if welding to an external component is not required, the duct box could be made of thinner metal.

Figure 8A:
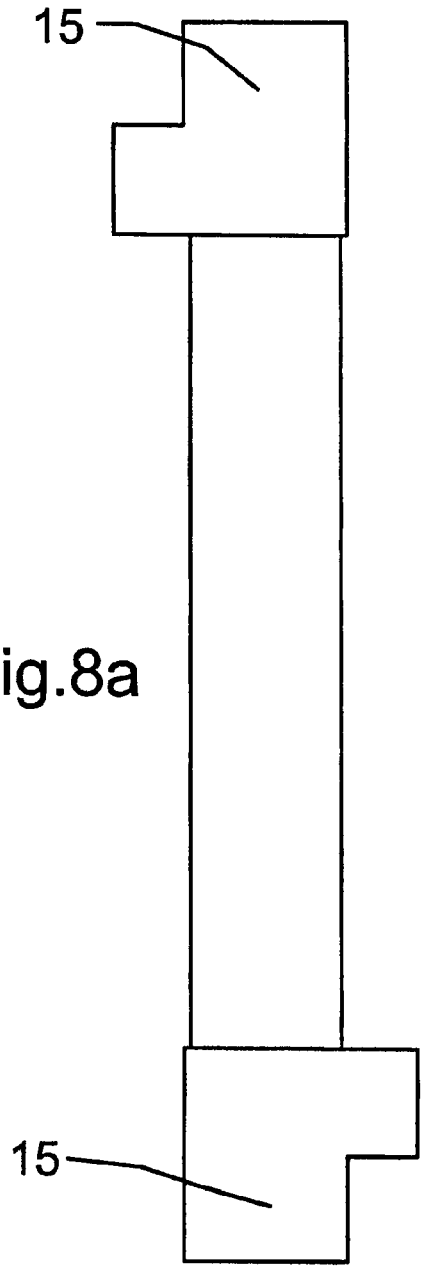
FIG. 8*a* provides an elevational view of the structure shown in FIG. 7*b*.
Figure 8B:
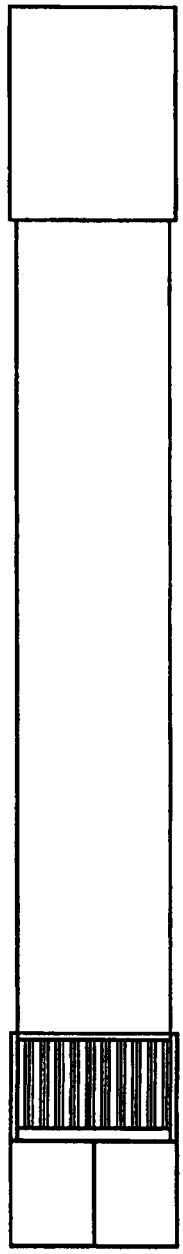
FIG. 8*b* provides an elevational view of the structure of FIG. 8*a*, the monolith having been rotated by 90.degree. relative to the structure of FIG. 8*a*.
Figure 8C:
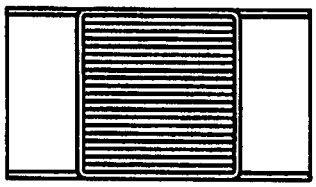
FIG. 8*c* provides an end view of the monolith of FIG. 8*a*.

FIGS. 8*a*-8*c* provide elevational and end views of the structure described with respect to FIGS. 7*a* and 7*b*. Thus, FIG. 8*a* shows duct boxes 15 installed at both ends of the monolith. FIG. 8*b* shows an elevation that is rotated by 90.degree. relative to FIG. 8*a*. FIG. 8*b* therefore provides a view as seen when looking into the duct, and shows the exposed interior of the monolith. FIG. 8*c* provides an end view, as seen from the bottom of the structure of FIG. 8*a*.

Figure 9:
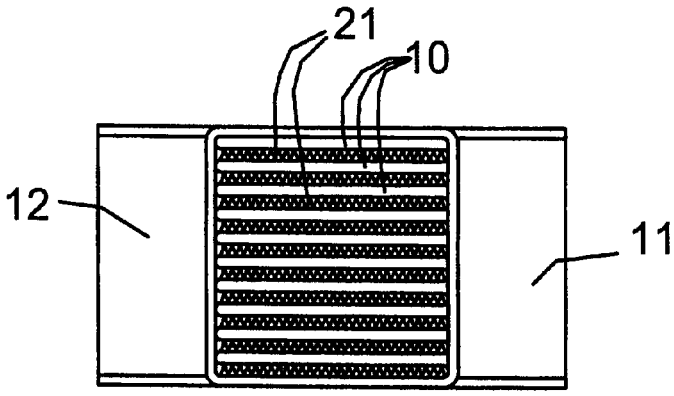
FIG. 9 provides an end view of the heat exchanger of the present invention, including the cut pieces of corrugated foil inserted within folds of the monolith.

FIG. 9 provides an end view of the monolith, showing a plurality of cut pieces of corrugated foil 21 inserted within the spaces defined by the folded foil. The insertion of cut pieces 21 is performed after the foil 1 has been folded into a monolith, and preferably after the combs, rectangular pieces, and duct boxes have been installed. The comb serves to facilitate the insertion of the cut pieces of corrugated foil, as it maintains the spacing between adjacent folds of the foil 1. FIG. 9 clearly shows the teeth 10 of the comb, inserted into the folds of the monolith. Note that half of the cut pieces must be inserted at one end, and the other half must be inserted from the other end. The reason for the latter is that the teeth of the comb block half of the channels. The channels blocked at one end are not blocked at the other end.

The cut pieces 21 can be inserted manually, one piece at a time. Alternatively, the cut pieces can be stacked in a magazine which holds them in the correct position, and the pieces can then be pushed simultaneously into the monolith.

The cut pieces 21 may be coated with a suitable combustion catalyst, or other catalyst, depending on the intended use of the heat exchanger. The cut pieces may be wholly or partially coated. However, the metal foil defining the monolith is normally not coated, as a coating would make it difficult to weld or braze. But if it were desired to coat the monolith, such coating could be done by dip coating the assembled structure.

Figure 10:
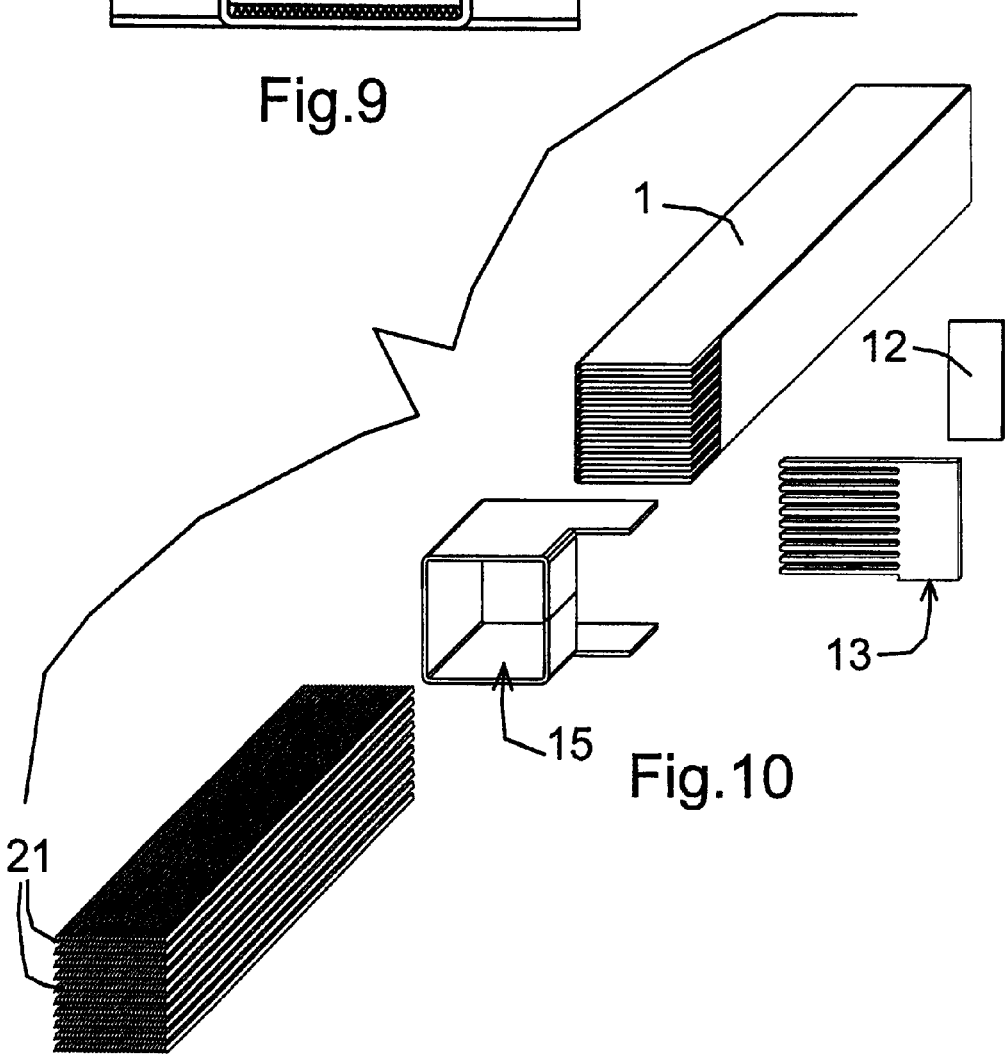
FIG. 10 provides an exploded perspective view, showing the various components of the heat exchanger of the present invention.
Figure 22:
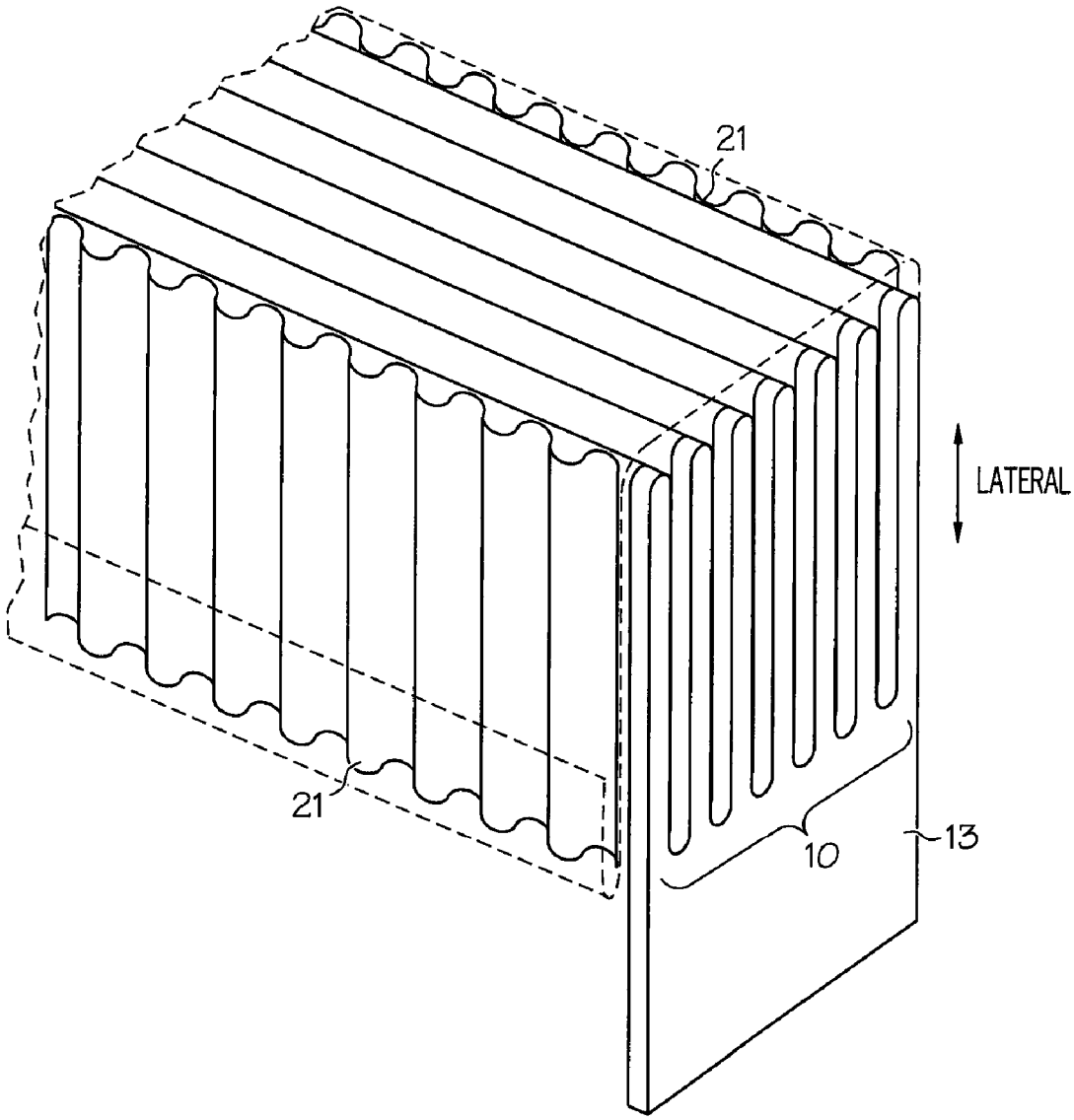
FIG. 22 provides a perspective view of the monolith having corrugated cut pieces inserted into the channels thereof.

For convenience of illustration, the cut pieces of corrugated foil are not shown, except in FIGS. 9, 10 and 22.

FIG. 10 provides an exploded perspective view which summarizes the construction of the heat exchanger of the present invention. The foil 1 is shown, after having been folded into a monolith, leaving openings for the ducts, defined by the notches or cut-outs described above. The figure clearly shows the monolith shell, defined by the flaps in the original piece of metal foil described above, and by the first and last folds of the monolith. The comb 13 is to be initially affixed to the end of the monolith, such as by laser welding or spot welding, to hold the folds in spaced-apart relation, and to define a wall of the duct. Brazing alloy is subsequently used to attach the comb 13 to the monolith. The rectangular piece 12 is similarly attached to the monolith, to define the opposite wall of the duct. One then slides the duct box 15 onto the end of the monolith, until stopped by the spine of the comb. Finally, the cut pieces 21 of corrugated foil are inserted into the spaces between adjacent folds.

It is understood that, for each monolith, there will be a pair of combs, a pair of rectangular pieces, and a pair of duct boxes. Also, one should preferably prepare a sufficient quantity of cut pieces 21 to fill all of the available spaces in the monolith.

The foil used to make the cut pieces 21 can be very low-cost corrugated foil, which could be made of Fecralloy, having a thickness of the order of about 0.002 inches. In the figures, the cut pieces 21 are shown to define straight channels, but one could instead use a variety of channel configurations, such as wavy or skew corrugations, as are known in the heat exchange industry, to promote heat transfer.

The cut pieces, if coated with catalyst, can be coated on one side or both sides. As noted above, each side could be wholly or partly coated. Because both sides of a given cut piece will belong to the same fluid flow region of the monolith, it is preferred that, if a catalyst coating is used, the same catalyst should be used on both sides. But the invention is not limited to this configuration, and it is conceivable that different catalysts could be coated onto the two sides of the cut pieces.

The folded structure of the monolith inherently defines two sides, each side corresponding to a respective side of the original piece of metal foil. When the piece is folded to form a monolith, the monolith therefore defines two distinct fluid flow regions, corresponding to the two sides of the original piece. These two regions are not in direct fluid communication with each other, but are in heat exchange relationship, as heat can flow through the foil which separates the regions from each other.

The two ducts provide access to the two respective fluid flow regions of the monolith. It is clear, therefore, that by placing a first catalyst on the cut pieces belonging to the first region, and a second catalyst on the cut pieces belonging to the second region, one can conduct two distinct reactions in the two regions of the monolith.

A process for making the low-cost heat exchanger of the present invention can be summarized as follows. First, one prepares the flat foil, with notches or cut-outs at the corners, and folds the foil back and forth upon itself to form the monolith. Next, one forms the combs, such as by laser cutting, and inserts a comb into each end of the monolith. Next, one forms a duct box for each end, and a rectangular piece, and one affixes the rectangular piece to the monolith, and one slides the duct boxes onto the ends. Next, one applies a brazing alloy to all joints on the resulting structure, and brazes the structure in a suitable furnace. Finally, one inserts the cut pieces of corrugated foil, which may or may not have a catalyst coating, into the spaces defined by the monolith.

For the above-described process to work most effectively, the foil must be a nickel-based alloy. For a heat exchanger rated up to about 700.degree. C., a 300 series stainless steel alloy, which is of medium expense, is preferred. For higher temperature ratings, the foil is preferably a relatively expensive nickel-based alloy, typically the alloy sold under the trademark Inconel. A preferred alternative, for all temperature ranges, is to use a relatively inexpensive iron-based foil, such as that sold under the name Fecralloy. In the latter case, before the duct boxes are installed, one would weld the joints where the foil defining the monolith meets the combs. Laser welding or spot welding can be used to hold the joints where the monolith foil contacts the combs. Brazing alloy can later be used to attach the comb to the monolith. After installation of the duct boxes, the brazing alloy would be applied to the duct joints, not to all joints.

The invention can be practiced with yet another process which avoids brazing altogether. First, one prepares the foil, forming the notches or cut-outs in the corners, and folds the foil back and forth upon itself to define a monolith. Next, one prepares the combs, preferably by laser cutting, and inserts the combs into each end of the body. Next, using a laser welder, one welds the joints where the foil defining the monolith meets the combs. Next, one forms the duct boxes and rectangles, and installs them as described above. Next, one uses a laser welder to weld the duct joints. Finally, as described above, one inserts the cut pieces of corrugated foil, which may or may not be coated with a catalyst.

Figure 11:
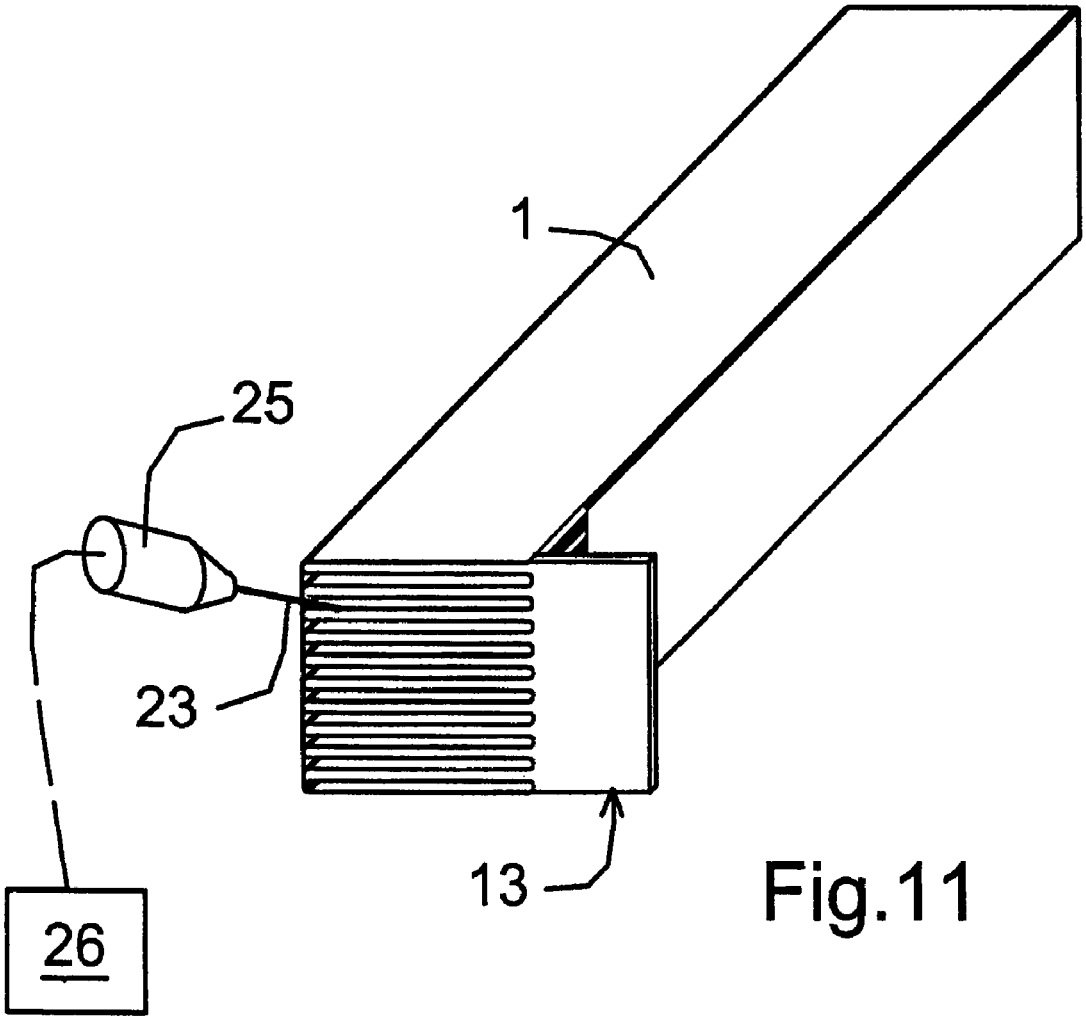
FIG. 11 provides a perspective view of a comb which has been inserted into the monolith of FIG. 3, and showing the joints being sealed by a laser welder.

FIG. 11 shows the use of a laser welding device for sealing the heat exchanger of the present invention. As shown in the figure, metal foil 1 has been folded into a monolith, and comb 13 has been inserted at one end. A laser welding machine includes computer-controlled device 26 which is programmed to control the orientation and power level of laser head 25. The device 26 is preferably capable of precisely positioning the laser beam with a multiple-axis control. A laser beam 23 is traced across all of the seams where the monolith meets the teeth of the comb. Heat from the laser beam causes the metal to soften or melt locally, and to form a fusion weld between the comb and the foil defining the monolith. The precise positioning of the laser beam enables the weld to be formed at all locations where the comb and the monolith meet. The result is a strong mechanical joint which also comprises a gas-tight seal.

The structure of the heat exchanger, as described above, can be varied, as described below.

Figure 12:
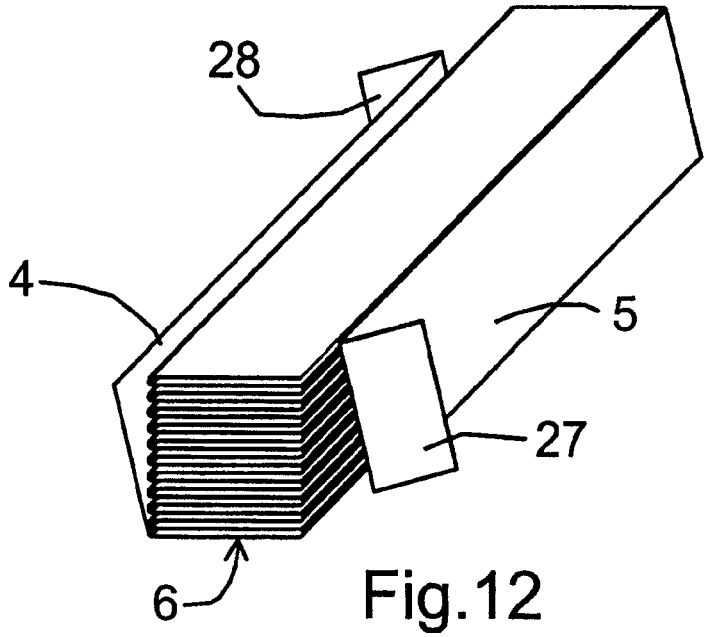
FIG. 12 provides a perspective view of an alternative embodiment of the monolith, wherein a single cut is made in each corner of the original piece of metal, and wherein wings are folded from the monolith to define part of a duct.

One alternative embodiment is illustrated in FIG. 12. Unlike the previous embodiment in which rectangular notches were formed by making two cuts at opposite corners of the flat metal foil, the embodiment of FIG. 12 uses only a single cut at such corners. The cut allows the formation of flaps 27 and 28, which are folded along a line which would have been the location of the other cut in the previous embodiment. As shown, the flaps 27 and 28 are arranged to similarly perform the function of the rectangular pieces 12 of the previous embodiment. That is, flaps 27 and 28 define a wall of a duct. The embodiment of FIG. 12 reduces the number of seams to be sealed, because the flaps 27 and 28 are integrally formed with the monolith.

Figure 13:
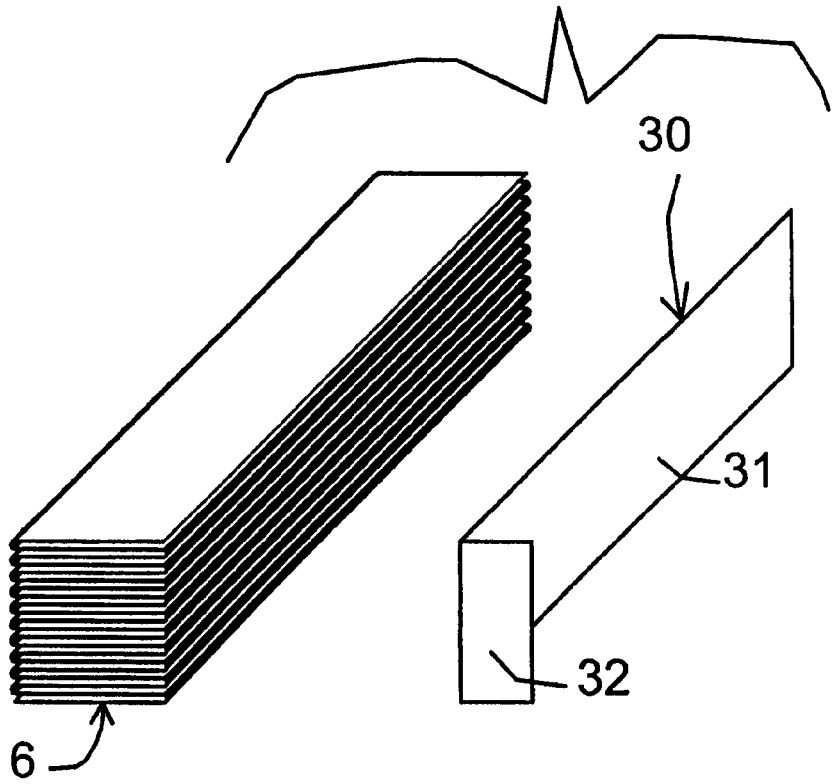
FIG. 13 provides a perspective view of another alternative embodiment, wherein the metal defining the monolith does not have notches or cuts, and wherein a separate piece of metal is used to cover the monolith and to define part of a duct.

FIG. 13 shows another alternative embodiment. In this embodiment, no notches or cuts are made in the foil defining the monolith 6. Instead, separate side cover pieces 30 are made for each side of the monolith. The cover pieces are made from foil, which may be the same as that used to make the monolith, or which may be made of thicker material. The cover piece includes a side panel 31 and a flap 32. The side panel is joined to the monolith, preferably by welding, and the flap 32 performs the function of rectangular piece 12 of the first embodiment.

For simplicity of illustration, FIGS. 12 and 13 do not show the duct boxes or the cut corrugated pieces. It is understood that such components, as described with respect to the previous embodiments, would be included in the complete heat exchanger.

Figure 14:
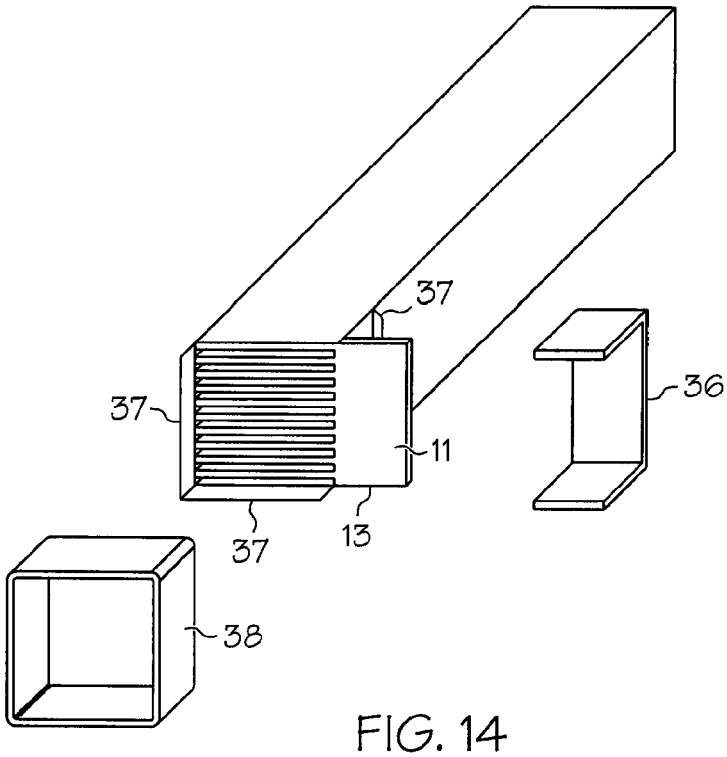
FIG. 14 provides an exploded perspective view, showing the various components of a heat exchanger of the present invention.
Figure 15:
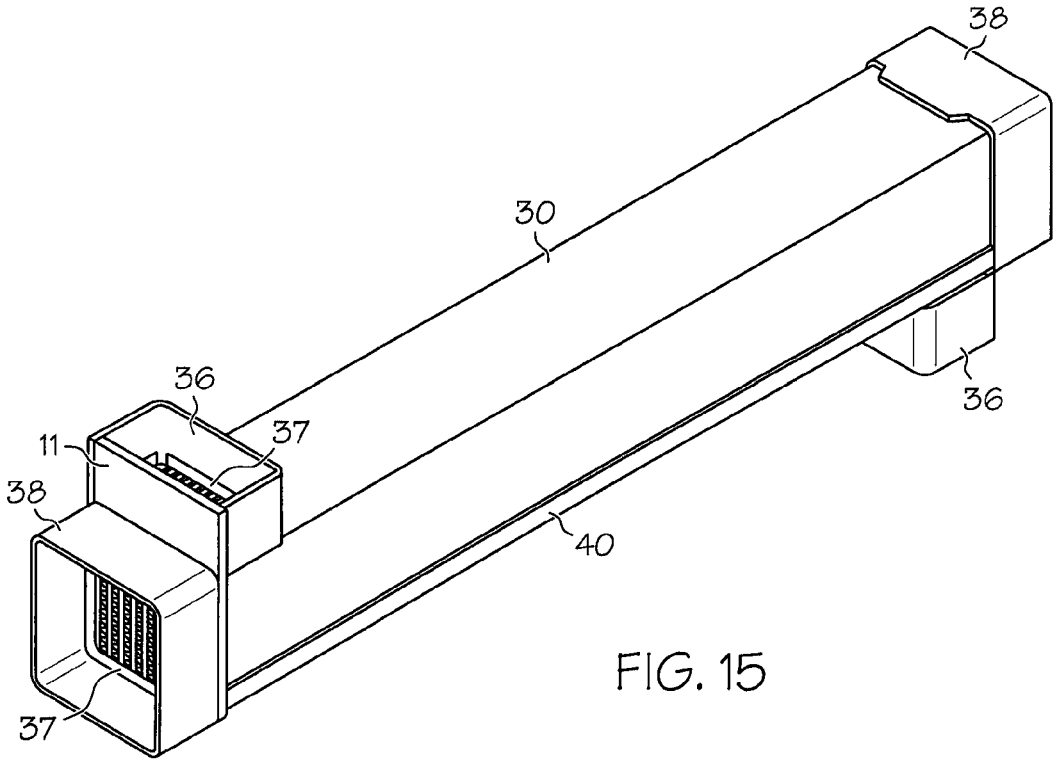
FIG. 15 provides a perspective view of an alternative embodiment of a heat exchanger of the present invention.

FIG. 14 shows an embodiment of the present invention. A u-shaped piece of metal 36 can be used to form a portion of the ducts or fluid openings adjacent the ends of the monolith. The spine 11 of the comb 13 forms the remaining portion of the fluid openings adjacent the ends of the monolith. As shown in FIG. 15, the monolith requires two such u-shaped metal pieces to form two fluid openings, each one adjacent an end of the monolith. The u-shaped piece 36 can be made of the same material and have the same thickness as the comb 13, or alternatively the u-shaped piece 36 can be made of thinner or thicker material. For example, the u-shaped piece can have a thickness range of about 0.02 to about 0.12 inches, or about 0.06 inches. If the u-shaped piece forming that portion of the duct is to be welded to the spine 11 and cover piece, such as by a laser, the u-shaped piece 36 is preferably about the same thickness as the spine 11 of the comb 13. If the duct is brazed only, the u-shaped piece 36 can be about the same thickness as the duct collar 38 as discussed below.

As shown in FIG. 14, the duct or fluid opening at each end of the monolith, which provide fluid flow to the channels, can be formed by a duct collar 38. The duct collar 38 is made of metal and can be folded to form a box and welded, or has a unitary construction consisting of four side walls configured to fit on the end of the monolith. The duct collar 38 forms the walls of the duct at the end of the monolith in a similar manner as the duct box 15 of FIG. 7. However, the duct collar 38 of FIG. 14 does not have flaps that must be bent and welded in order to form one wall of the duct. The perimeter lip of the duct collar 38 mates with the flat face of the comb 13 such that the collar 38 can be welded to the comb to provide fluid communication with the interior flow channels of the monolith. Preferably, the combs 13 are attached to each end of the monolith. In this arrangement, the combs 13 are positioned between the duct collars 38 and monolith ends.

The duct collar 38 can be made of the same material and have the same thickness as the comb 13, or alternatively the collar 38 can be made of thinner or thicker material. If the collar 38 is welded to the comb 13 and/or cover piece tabs 37, such as by a laser, the collar 38 is preferably as thick or thicker than the comb 13.

As further shown in FIG. 14, cover pieces 30 can form a protective shell around the monolith, with one cover piece 30 forming two sides of the monolith and the other cover piece 30 forming the other two sides of the monolith. The cover pieces 30 can be two flat, rectangular foil pieces bent along their center to form perpendicular faces that can be aligned with the side walls of the monolith. Notches can be cut into the flat cover piece 30 prior to bending to provide fluid openings adjacent the ends of the monolith. Preferably, the flat cover pieces 30 have notches cut on opposite side corners of the flat piece. Following the bending of the flat cover pieces 30, the ends of the perpendicular faces can form tabs 37 that extend past the comb 13 and ends of the monolith. The cover pieces can also have tabs 37 that are flipped up in a parallel position to the spines 11 of the combs 13. The duct collar 38 and/or u-shaped piece 36 fit around the tabs 37 such that the tabs 37 overlie the inner face of the collar 38 and/or u-shaped piece 36 as shown in FIG. 15. The tabs 37 are preferably formed by the cover pieces 30 in order to reduce manufacturing time and costs. Alternatively, the tabs 37 can be incorporated into the design of the monolith. Thus, the cover pieces 30 forming the protective shell around the monolith can be selectively with or without the tabs 37 depending on design preference.

The use of cover pieces 30 to form the shell around the monolith, rather than folding the ends of the monolith around its accordion body to form a cover, allows for different thicknesses of metal to be used. For example, the shell around the monolith can be formed from cover pieces 30 having a thickness of 0.004 inches and the monolith can be formed from a thinner metal foil of 0.002 inches. In another example, the cover pieces 30 and monolith can be formed of a foil having a thickness of 0.004 inches. The ability of using a thinner metal foil to form the monolith can reduce the overall costs of making the heat exchanger.

FIG. 15 provides a prospective view of the heat exchanger according to an aspect of the present invention. The heat exchanger can have dimensions, for example, measuring 1.5 inches wide, 1.5 inches high and 12 inches long. The heat exchanger preferably weighs less than one pound and more preferably about 0.75 pound. The heat exchanger can effectively operate at temperatures up to 900° C. and can handle up to a 2.5 kw heat load. Turning to the structure, FIG. 15 illustrates the heat exchanger having ducts formed by the duct collar 38, the u-shaped piece 36 and the spine 11 of the comb 13. The duct collar 38 fits around the tabs 37 of the cover pieces 30 extending past the comb 13. The duct collar 38 is preferably welded or brazed to the tabs 37 of each cover piece 30 in order to form gas-tight seals. The two cover pieces 30 forming the shell around the monolith are joined together at seam 40 and, at a similar second corresponding seam 40 located 180° from seam 40 as shown. Thus, there are two seams 40 located 180° apart. As will be clear below, the seam 40 can be formed by various techniques such as welding or brazing.

Figure 16:
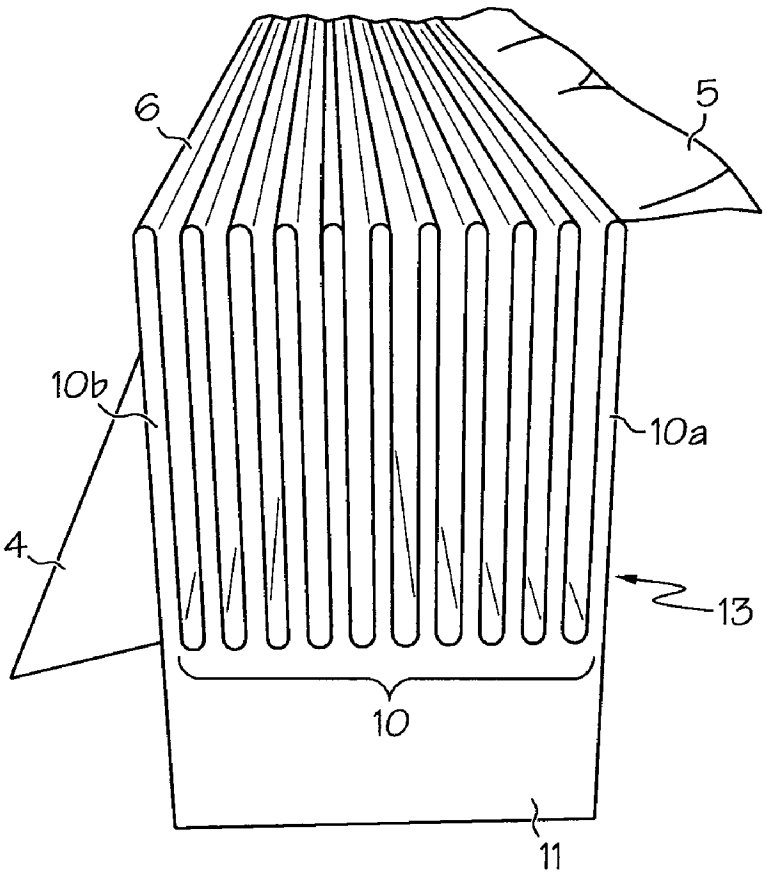
FIG. 16 provides a perspective view of monolith and comb wherein the monolith has end tabs extending beyond the comb structure.

As shown in FIG. 16, the monolith 6 can have end flaps 4, 5. The end flaps 4, 5 can be joined with one or more cover pieces 30 in order to form a seam 40 as shown in FIG. 15. Prior to welding or brazing, the two cover pieces 30 are positioned around the monolith such that the ends of the cover pieces 30 align with the end flaps 4,5 of the monolith to form a three-layer unsealed seam.

Figure 17:
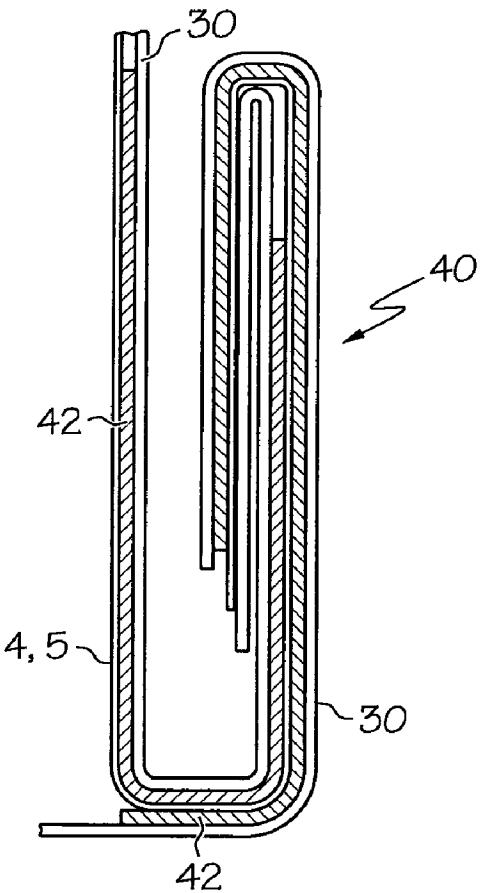
FIG. 17 provides a side cross-section view of a three-layer seal formed by cover pieces and a tab of the monolith.

FIG. 17 illustrates a sealed three-layer seam 40. The three-layer seam comprises the ends of the two cover pieces 30 and one end flap (such as 4 or 5) of the monolith. In making the seam, the end flap (such as 4 or 5) of the monolith is sandwiched between the ends of the cover pieces 30 to form an unsealed three-layer seam; there is a corresponding seam on the opposite side of the heat exchanger shell. Braze alloy can be placed at the end of the three-layer seam. The three-layer seam can also be tack welded at locations along the length of the monolith in order to secure the layers together prior to folding. Preferably, the layers are tack welded together below the tip or end of the seam where the braze alloy is placed. Each unsealed three-layer seam is folded over itself as shown in FIG. 17 before being brazed. Alternatively, the three-layer seam can be sealed by laser welding the end flap of the monolith (4 or 5) to the ends of the two cover pieces 30. In another alternative, the three-layer seam can be sealed by seam-welding. For example, roller-shaped electrodes can lay down a series of spot welds which can be spaced closely. By spacing the spot welds close to one another, the three-layer seam can be hermetically sealed. Transfer tape 42 can be placed on the ends of the cover pieces 30 in order to create a gas-tight seal during brazing of the three-layer seam 40. As shown, the transfer tape 42 is in contact with the ends of the two cover pieces 30 and end flap (4 or 5) during brazing of the seam 40. The transfer tape 42 is preferably made of powdered braze alloy and adhesive binder.

Figure 18:
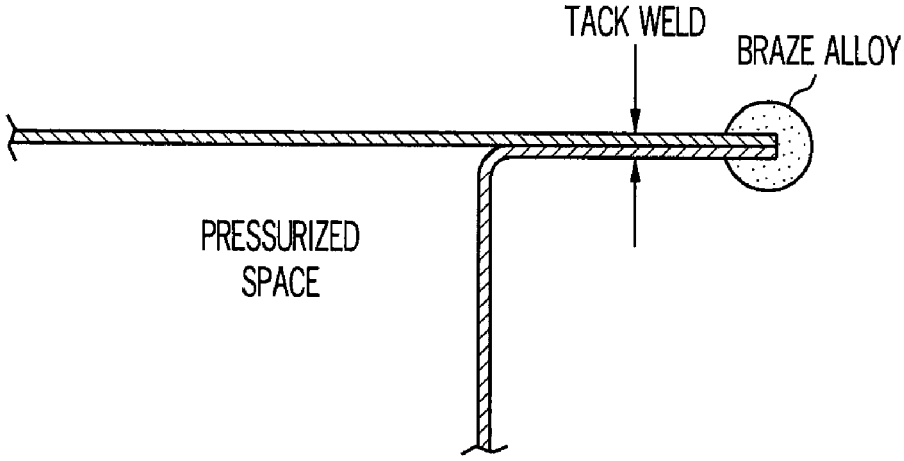
FIG. 18 provides a side cross-section view of two metal foil sheets sealed together.
Figure 19:
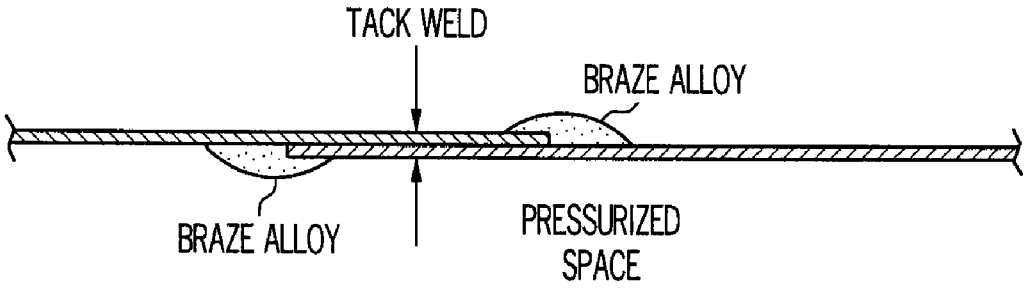
FIG. 19 provides a side cross-section view of two metal foil sheets sealed together.

The use of two cover pieces 30 to form the four sides of the shell around the monolith allows for a three-layer fold to be formed rather than having to make a lap seam that requires tack welding of foil-to-foil (such as end flap 4 and 5 being overlapped) as shown in FIG. 19. Tack welding as shown in that figure involves one of the welding electrodes being placed in the space that will eventually be pressurized. This has the disadvantage of being susceptible to leaks in the seal formed by the tack weld. Occasionally, tack welding can create a hole through which fluid contained within the heat exchanger can leak. Thus, it is desirable have the braze alloy flow between the foil sheets and adequately seal the seam formed by the foil sheets such that fluid from the pressurized space does not leak through. Even if braze alloy flowed around the tack weld of FIG. 19, the seam would still be susceptible to leaks if the tack weld created a hole from which fluid from the pressurized space could leak through. The configuration shown in FIG. 18 however allows brazed alloy to flow around the tack weld and seal the space between the foil sheets in fluid contact with the pressurized space of the heat exchanger. As such, even if a hole is created by an imperfect tack weld, the braze alloy can adequately seal the seam formed by the foil sheets. As shown in FIG. 18, a hole created by an imperfect tack weld is not in fluid contact with the pressurized space once the braze alloy seals space between the foil sheets.

FIG. 16 illustrates an alternative embodiment of the comb 13. The comb 13 shown has eleven teeth 10 instead of ten teeth 10 as shown in FIG. 4. The spacing of the teeth on the eleven-tooth comb provides two end teeth 10*a* and 10*b* on each end of the spine 11, which eliminates the one side of the spine having a toothless end as with the ten-tooth comb of FIG. 4. The eleven-tooth design gives end teeth 10*a*, 10 *b* that provide support for the outermost channels of the monolith 6. That is, the end teeth 10*a*, 10*b* align with the outermost channels of the monolith. The support provided by the end teeth 10*a*, 10*b* prevent the walls of the outermost channels of the monolith from collapsing during brazing, welding or operation of the heat exchanger. The eleven-tooth comb further provides an interface with the duct box 15 or duct collar 38. The duct box 15 or collar 38 can be welded or attached by other means to the eleven-tooth comb along both end teeth 10*a*, 10*b* in order to provide a rigid and strong structure.

Figure 20:
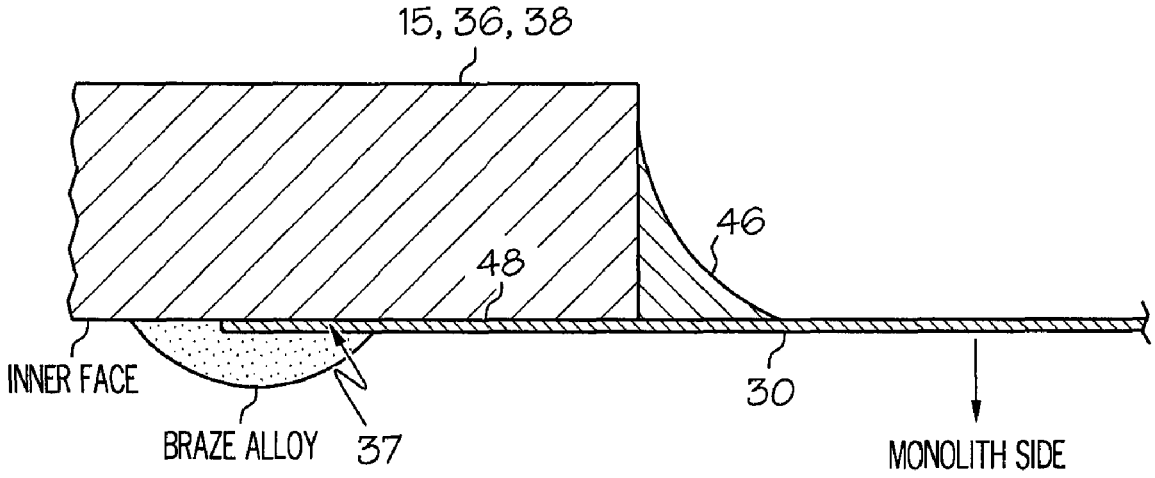
FIG. 20 provides a side cross-section view of a portion of a duct of a heat exchanger of the present invention. The duct portion is sealed to a cover piece forming the shell of the heat exchanger.

FIG. 20 illustrates a cross-section view of the seal that is formed between the duct box 15, u-shaped piece 36 or duct collar 38 and at least one tab 37 of a cover piece 30. As discussed above, the tab 37 of a cover piece 30 can overlie the inner face of the duct component, such as 15, 36, 38, that forms the duct providing fluid communication with the interior flow channels of the monolith. The overlap between the tab 37 and a duct component (36 and 38) is illustrated in FIG. 15. The tab 37 of a cover piece 30 is tacked and/or brazed to the inner face of a duct component (15, 36, 38). In this arrangement, the brazed tab 37 is in contact with the channels of the monolith. A brazing alloy satisfying the American Welding Society (AWS) specifications of AWS A5.8 BNi-2, AWS A5.8 BNi-5 or AWS A5.8 BNi-9 can be used to secure a tab 37 to a duct component (15, 36, 38) or the inner face thereof. A brazing alloy might include, for example, a Nicrobraz® alloy, such as Nicrobraz®-150, -LM or -30, supplied by Wall Colmonoy Limited located at Pontardawe, Swansea SA8 4HL Great Britain. The brazing alloy melts during brazing and wicks along the interface of the tab 37 and the duct component (15, 36, 38) in order to form a seal. As used herein, the technique of brazing consists of heating the braze alloy and/or the parts and pieces of the heat exchanger above 425° C.

The interface 48 between the tab 37 or cover piece 30 and duct component (15, 36, 38) opposite the brazed seal discussed above can be imperfect, for example, there can be a gap between a duct component (15, 36, 38) and a cover piece 30 because the cover piece 30 may not be in contact or flush with the inner face of the duct component. Gaps or open spaces in the interface 48 can allow fluid to leak into the interior channels of the monolith. A filler material 46 can be applied at the interface 48 opposite the brazed end in order to seal the seam or fill the gap that is formed between the duct components and cover pieces when the duct component is fitted over the monolith ends. The filler material 46 can be a nickel-based powder composition that does not melt during brazing. The filler material 46 can further comprise iron, chromium, silicon, boron, phosphorus, combinations thereof and the like. The filler material 46 can comprise nickel in a weight percent, based on the total weigh of the material 46, of greater than 5, 10, 15, 50, 75, 80, 90, 95 or 99.5. The filler material 46 might include, for example, a Nicrogap® alloy supplied by Wall Colmonoy Limited noted above. The Nicrogap® alloy might include, for example, Nicrogap®-100, -106, -108, -112, -114, -116 or -118. The filler material 46 is preferably not mixed with a brazing alloy that melts prior to being applied to the gap. Alternatively, a brazing alloy can be used as filler material 46 to seal the gap. During brazing, the brazing alloy used to seal the tab 37 to a duct component (15, 36, 38) can wick or flow along the interface 48 and come into contact with the filler material 46. The braze alloy and filler material 46 can fuse together and create a gas-tight seal between the ducts and cover pieces of the heat exchanger. Because the braze alloy wicks into the filler material 46, the filler material 46 is not disturbed or generally dislodged or repositioned during brazing.

The filler material 46 can create a smooth and attractive fillet at the edge of a duct component (15, 36, 38) and tab 37 or cover piece 30 interface. The fillet created by the filler material 46 can be a back-up or secondary seal to the brazed seal between the tab 37 and duct component (15, 36, 38) discussed above.

Figure 21:
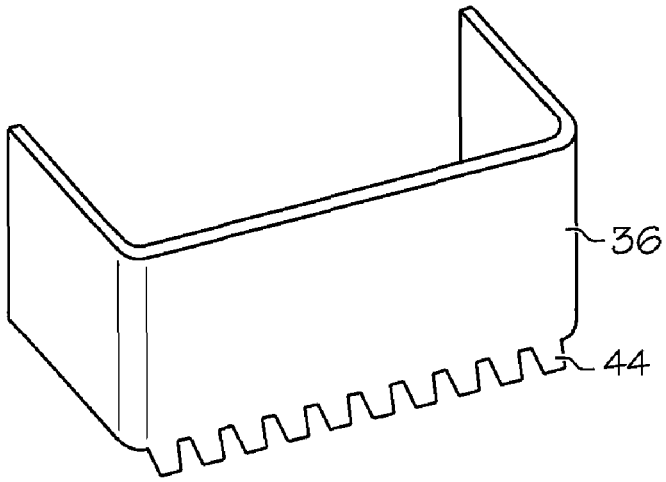
FIG. 21 provides a perspective view of a unshaped piece of metal used to form a duct of a heat exchanger of the present invention.

FIG. 21 shows another embodiment of the u-shaped metal piece 36. The u-shaped piece 36 can have a plurality of teeth 44 spaced along its edge. The teeth 44 are spaced apart in order to align and fit within the channels or available spaces of the monolith. The teeth 44 provide a stop plate for the cut pieces of corrugated foil 21 that can be inserted into the channels of the monolith. That is, the corrugated foil pieces 21 are stopped from sliding into and past the duct space formed by the u-shaped piece 36 and the spine 11 of the comb 13, as is shown in FIG. 15. Without the teeth 44, the pressure and force of the fluid flowing through the heat exchanger can move the corrugated foil 21 along the channels of the monolith and into the duct space. In this case, the fluid flow in the heat exchanger can be impeded by the corrugated foil pieces 21 extending into the fluid openings created by the ducts of the heat exchanger.

In another embodiment, a plurality of cut pieces 21 can be positioned and/or inserted within the channels of the monolith. As discussed above, the cut pieces 21 can be coated with a catalyst or sorbent, on one side or all sides, prior to being inserted into at least one channel of the monolith. A cut piece 21 as shown in FIGS. 9 and 10 can be configured in various ways in a channel of the monolith to provide enhanced structural integrity to the heat exchanger. It is to be understood that a cut piece 21 can have various face topographies, for example, a wave pattern of corrugations in the lateral or longitudinal direction or a series of spherical bumps. As used herein, the lateral direction runs parallel with the teeth 10 of the comb 13, as shown in FIGS. 16 and 22, and the longitudinal direction runs perpendicular the teeth 10. As shown in FIG. 9, the corrugated cut pieces 21 are in the longitudinal direction as positioned in the channels of the monolith. As shown in FIG. 22, cut pieces 21 configured to have lateral corrugations can be inserted into the outermost flow channels of the monolith. In this arrangement, the cut pieces 21 can be used to strengthen the outer walls of the monolith and provide enhanced structural integrity and support to the shell of the heat exchanger. The lateral corrugations can substantially block the flow of fluid through the outermost channels of the monolith or any channel that a laterally-corrugated cut piece 21 is inserted. The laterally-configured cut pieces 21 can prevent collapse of the side walls of the monolith or cover pieces 30 if low pressure is experienced within the flow channels of the heat exchanger.

The cut pieces 21 in the outermost channels of the monolith can be attached, such as by brazing, therein so the pieces 21 do not move or slide during operation or fluid flow through the channels. Such brazing of the cut pieces 21 to the monolith channel walls and/or the cover pieces 30 can create rigid walls in the outermost channels that prevent bending or twisting of the heat exchanger. By being bonded to the channel walls and/or the cover pieces 30, the cut pieces 21 can prevent the walls of the monolith and cover pieces 30 from ballooning or being deformed during pressure testing or from the high operating temperature or internal pressure of the heat exchanger. As shown in FIG. 22, cut pieces 21 having lateral corrugations are preferably used in the outermost channels in order to provide rigidity to the heat exchanger. Laterally-corrugated cut pieces 21 in the outermost channels of the monolith add strength to the channels and create stiff or inflexible regions therein that resist bending and general operating stresses. Thus, brazing the cut pieces 21 to the channel of a monolith, such as an outermost channel, can create a durable heat exchanger structure capable of operating under extreme conditions such as high temperatures or pressures.

Figure 23:
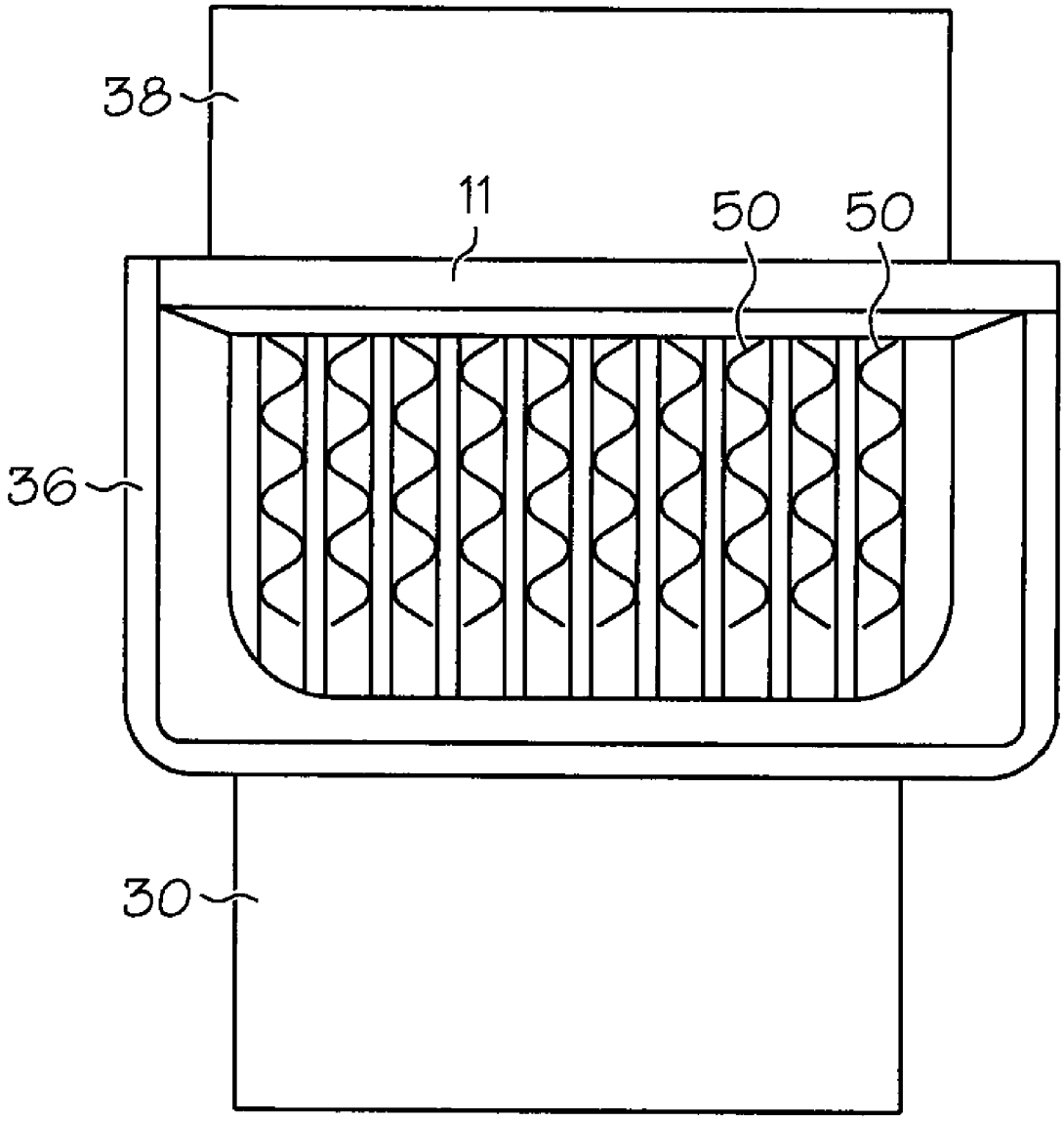
FIG. 23 provides a top view of a fluid duct having flow vanes inserted into the channels thereof.
Figure 24:
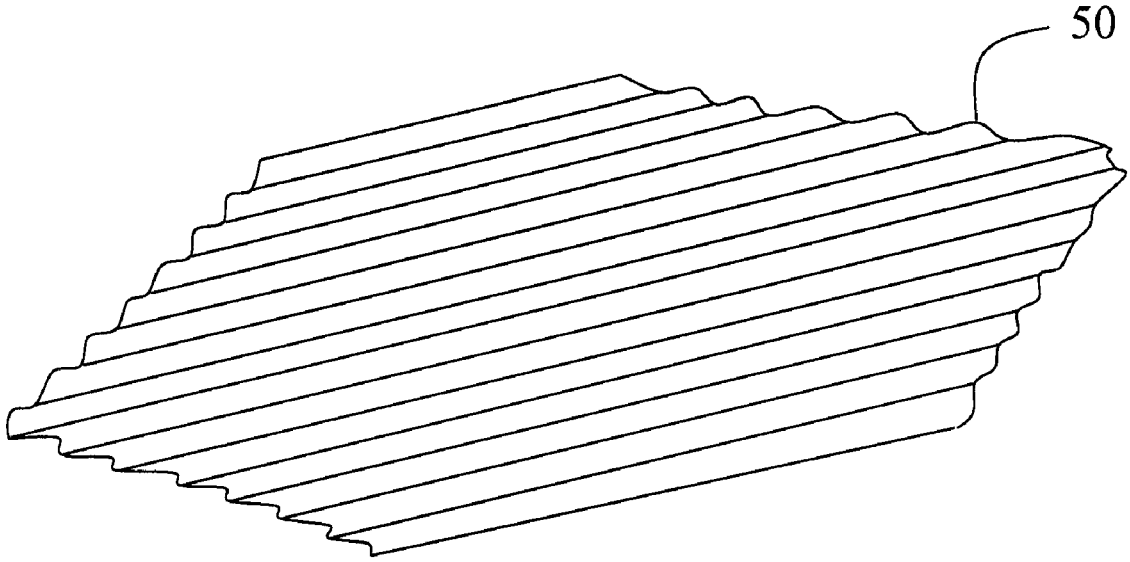
FIG. 24 provides a side perspective view of a flow vane that can be inserted into the channels of a fluid duct.

FIG. 23 illustrates another embodiment of the present invention. Flow vanes 50 can be inserted into fluid ducts formed by duct components (15, 36, 38) to provide structural integrity and rigidity to the heat exchanger. As shown, a plurality of flow vanes 50 are inserted into a fluid duct formed by the spine 11 of the comb 13 and the unshaped piece 36. The flow vanes 50 can be positioned to fit within the channels of the monolith that are exposed by the fluid ducts of the heat exchanger. The flow vanes 50 can be configured in various ways in a channel of the monolith to provide enhanced structural integrity to the heat exchanger near the fluid ducts. The topographies of the flow vanes are configured so as to convey the fluid from the longitudinal direction within the cut pieces 21 to the lateral direction within the duct formed by the U-shaped piece 36. An example flow vane 50 is shown in FIG. 24. As shown, the flow vane 50 can have corrugations arranged at any angle ranging from the longitudinal or lateral direction.

The flow vanes 50 can be attached, such as by brazing, to the walls of channels of the monolith and/or cover pieces 30 to prevent the flow vanes 50 from moving or sliding during operation or fluid flow through the ducts. Brazing of the flow vanes 50 to the monolith channel walls and/or the cover pieces 30 can create rigid walls in the fluid duct that prevent deformation of the monolith 6 during operation or pressure testing. The flow vanes 50 positioned within the channels of the monolith also prevent migration of the cut pieces 21 into the fluid duct area. Thus, the flow vanes 50 act as stops for the cut pieces of corrugated foil 21 that can be inserted into the channels of the monolith.

The flow vanes 50 can be made of metal. For example, a nickel-based alloy such as the Inconel, which is a trademark of Huntington Alloys Corp., of Huntington, W. Va., can be used to make the flow vanes 50. The flow vanes 50 can have a thickness range of about 0.001 inches to about 0.01 inches, or about 0.002 inches.

The invention can be modified in other ways, which will be apparent to the reader skilled in the art. For example, the construction of the ducts, at or near the ends of the monolith, can be accomplished in different ways. In the above description, the duct boxes, collars, u-shaped pieces, combs, and rectangular pieces comprise means for defining the ducts. The components could be varied, as long as the ducts are constructed to convey fluid, sealed from the outside, into or out of the appropriate portion of the monolith. The order of the steps of the assembly of the heat exchanger can also be varied. For example, it is not necessary to prepare the combs 13 before the rectangular pieces 12; instead, the order of these two steps could be reversed.

The above and other modifications, which will be apparent to the reader skilled in the art, should be considered within the spirit and scope of the following claims.

The invention claimed is:

1. A heat exchanger comprising:

a metal monolith having two ends and a plurality of channels through which fluid flows, said plurality of channels including two outermost channels;

a shell surrounding said monolith, wherein said shell is open on both ends to provide fluid flow to said channels, said shell further comprising two fluid openings adjacent said ends of said monolith;

at least one comb comprising a spine and a plurality of teeth, wherein the comb is attached to one end of said monolith and said teeth are aligned with a portion of said channels to provide a fluid flow stop at one end of said monolith;

at least one duct collar attached to one end of said monolith, wherein said comb is positioned between said duct collar and said monolith end;

at least one u-shaped metal piece attached to at least one said shell fluid opening adjacent said end of said monolith, wherein said u-shaped metal piece and said spine form a duct opening to provide fluid flow to said channels; and said two outermost channels having cut pieces configured such that the fluid flow through said two outermost channels is substantially blocked and said cut pieces provide enhanced support to said shell of said heat exchanger.

2. The heat exchanger of claim 1, said cut pieces positioned in said two outermost channels being laterally configured and corrugated.

3. The heat exchanger of claim 2, wherein said u-shaped metal has a plurality of teeth configured to fit in said channels, wherein said teeth provide a stop plate for said laterally-configured corrugated cut pieces.

4. The heat exchanger of claim 2, wherein said laterally-configured corrugated cut pieces are replaceable.

5. The heat exchanger of claim 2, wherein said plurality of channels other than said two outermost channels have longitudinally-configured corrugated cut pieces for directing fluid flow.

6. The heat exchanger of claim 5, wherein at least one of said plurality of longitudinally-configured corrugated cut pieces is coated with a catalyst.

7. The heat exchanger of claim 2, said laterally-configured corrugated cut pieces being attached to said two outermost channels.

8. The heat exchanger of claim 7, said laterally-configured corrugated cut pieces being brazed to said two outermost channels.

9. The heat exchanger of claim 7, wherein said laterally-configured corrugated cut pieces provide enhanced structural support to the heat exchanger to prevent deformation of said shell of said heat exchanger in the presence of a pressure differential.

10. The heat exchanger of claim 1, further comprising a plurality of flow vanes positioned in said channels exposed by at least one fluid opening adjacent an end of the monolith.

11. The heat exchanger of claim 1, further comprising a plurality of flow vanes positioned in said channels exposed by at least one fluid opening at an end of the monolith.

* * * * *